US005165547A

United States Patent [19]

Allison

[11] Patent Number: 5,165,547

[45] Date of Patent: Nov. 24, 1992

[54] LUNCH BOX INSULATING AND ARTICLE STORAGE LID

[76] Inventor: Jack Y. Allison, 220 W. Townsend, McAlester, Okla. 74501

[21] Appl. No.: 782,238

[22] Filed: Oct. 24, 1991

[51] Int. Cl.[5] ..... A45C 11/20

[52] U.S. Cl. ..... 206/545; 206/549

[58] Field of Search ..... 206/541, 542, 545, 549

[56] References Cited

U.S. PATENT DOCUMENTS

| | | | |
|---|---|---|---|
| 2,499,254 | 2/1950 | Parker | 206/545 X |
| 2,685,397 | 8/1954 | Ellswood | 206/541 X |
| 3,139,179 | 6/1964 | Cadotte | 206/549 |
| 4,190,155 | 2/1980 | Higley | 206/545 |

*Primary Examiner*—William I. Price
*Attorney, Agent, or Firm*—Robert K. Rhea

[57] ABSTRACT

A rectangular section of heat and cold insulating material dimensioned to fit and serve as a lid or top of a lunch box is centrally provided longitudinally with a cylindrical member of less length than the length of the lid. The cylindrical member is characterized by an upwardly open semicircular recess for containing cylindrical articles and normally closed by a tube of fabric material secured to one end of the cylindrical member and removably secured at its other end to the other end of the cylindrical member for containing other articles needed by a lunch carrying individual.

1 Claim, 1 Drawing Sheet

LUNCH BOX INSULATING AND ARTICLE STORAGE LID

BACKGROUND OF THE INVENTION

1. Field of the Invention

The present invention relates to lunch boxes, such as those used by construction workers who carry a lunch when no other source of food is available.

2. Description of the Prior Art

Lunch boxes presently available for construction workers and the like comprise a rectangular upwardly open container having a double wall or at least insulated surrounding sides, ends and bottom wall. However, this type of lunch box is provided with a single thickness, relatively thin plastic lid, hingedly connected at one end or one side of the lunch box, but does not provide insulating qualities against heat or cold for contained food.

This invention overcomes this deficiency by providing an insulating lid for such a lunch box and further provides a storage area for seasoning or other articles.

SUMMARY OF THE INVENTION

A rigid rectangular planar member dimensioned to fit a lunch box as a lid therefor, is preferably formed from insulating material, such as Styrofoam.

One planar surface of the lid is provided with a generally cylindrical elongated member centrally disposed thereon and secured thereto.

The major portion of the length of the cylindrical member between its end portions is recessed to define a semicircular upwardly open tube for cooperatively receiving cylindrical articles.

Fabric tubing overlies the cylindrical member and is removably secured thereto and contains other articles needed by the lunch carrier.

The principal object of this invention is to provide an insulating lunch box top and additionally provide an article containing handle secured to the lid for the convenience of the user.

DESCRIPTION OF THE PREFERRED EMBODIMENTS

Figure 2:
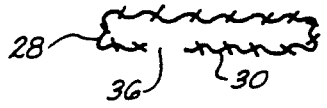
FIG. 2 is a fragmentary vertical cross sectional view to an enlarged scale, taken substantially along the line 2—2 of FIG. 1; and, FIG. 3 is an elevational view of one of the articles carried in the article cover.
Figure 1:
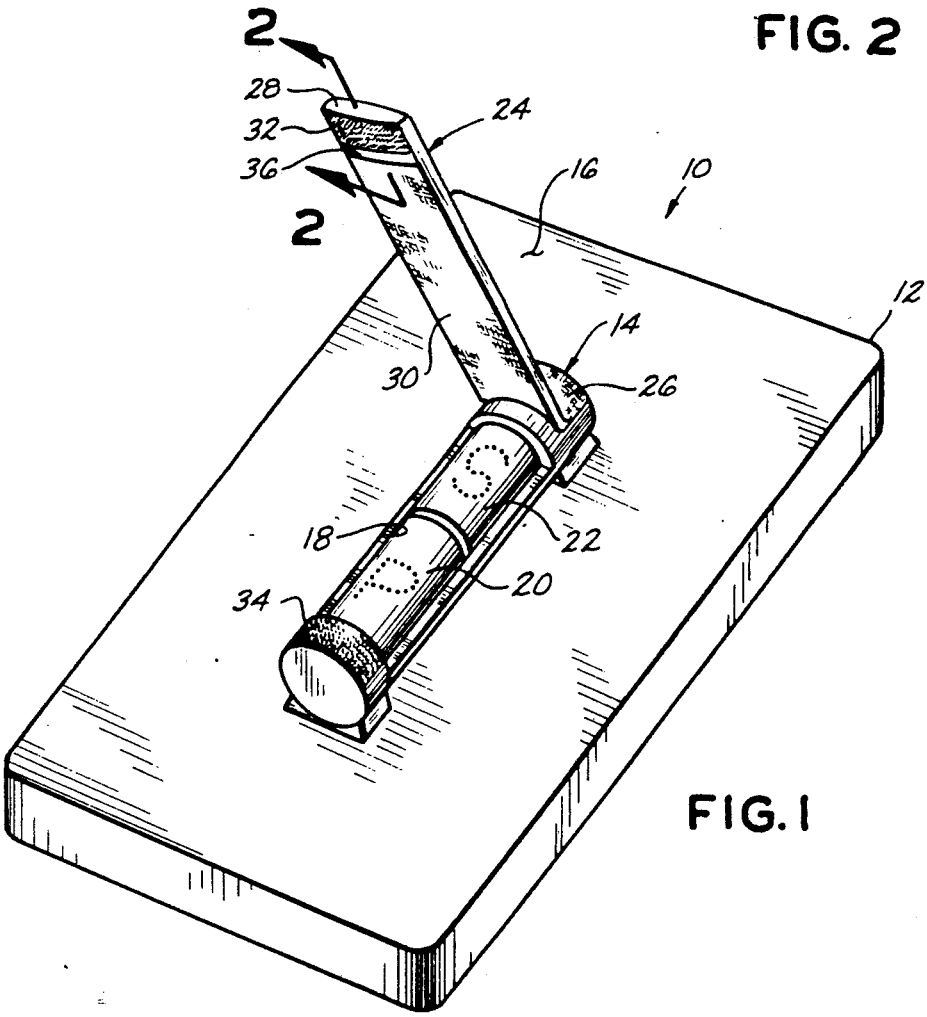
FIG. 1 is a perspective view of the lid and storage member, the latter being shown in open position.

Like characters of reference designate like parts in those figures of the drawings in which they occur.

In the drawings:

The reference numeral 10 indicates the lunch box lid comprising a generally rectangular planar section of insulating material, preferably formed from a selected thickness of rigid sheet of hot and cold insulating material, such as that presently marketed under the trademark "Styrofoam".

The lid 10 is provided with a flat top surface 16 and slightly rounded corners, as at 12, and its parallel side and end walls are snugly received in frictional relation by the inner surfaces of the respective side and end walls of a user's lunch box, not shown.

The lid 10 is further provided with a lifting handle 14, generally cylindrical in overall configuration which is longitudinally secured to the lid. The handle 14 is not intended for carrying the lunch box, but primarily for lifting and removing the lid 10 and replacing the same. The handle is centrally provided throughout the major portion of its length with an upwardly open semicircular recess 18 for removably receiving in longitudinal nesting relation a pair of cylindrical containers of food seasoning material such as pepper and salt indicated at 20 and 22, which may be easily removed from the recess 18 and replaced therein for storage.

An elongated tube of flexible fabric material 24 substantially equal in length with respect to the length of the member 14 and having a width sufficient to transversely cover the semicircular opening 18 is secured at one end to the cylindrical member as by pins or rivets 26.

The other end portion 28 of the tube 24 is closed and provided on its depending surface 30 with a transversely disposed section of material 32 presently available under the trademark Velcro cooperatively self adhering to a companion strip of Velcro material 34 bonded to the upwardly disposed surface of the end portion of the cylinder member 14 opposite the screws 26.

Figure 3:
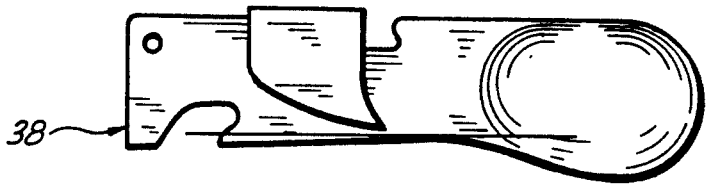

Adjacent its closed end 28, the depending surface of the tube is transversely slit substantially 180° as at 36, for receiving other articles, such as a combination can opener and spoon 38 (FIG. 3) and toothpicks, not shown.

Obviously the invention is susceptible to changes or alterations without defeating its practicability. Therefore, I do not wish to be confined to the preferred embodiment shown in the drawings and described herein.

I claim:

1. A lunch box lid comprising:

a planar rectangular member;

an elongated cylindrical lifting handle centrally secured to one planar surface of said member;

said handle having an upwardly open substantially semicircular in transverse section article receiving recess intermediate its ends; and, an elongated flexible cover secured at one end portion to one end portion of said member and having means for removably securing its other end portion to the other end portion of said member, said securing means comprising cooperating sections of self adhering material respectively bonded to adjacent end portions of said member and said flexible cover, said flexible cover comprising an elongated fabric tube closed at said other end portion and having a 180° slit in its surface normally contacting said other end portion of said member for storing articles within said tube.

* * * * *